United States Patent [19]

Savoly et al.

[11] Patent Number: 4,744,795

[45] Date of Patent: May 17, 1988

[54] TERPOLYMERS OF ETHYL ACRYLATE/METHACRYLIC ACID/UNSATURATED ACID ESTER OF ALCOHOLS AND ACIDS AS ANTI-SETTLING AGENTS IN COAL WATER SLURRIES

[75] Inventors: Arpad Savoly, Martinsville; José L. Villa, Bridgewater; Reuben H. Grinstein, Denville, all of N.J.; Solomon J. Nachfolger, Monsey, N.Y.

[73] Assignee: Diamond Shamrock Chemicals Company, Dallas, Tex.

[21] Appl. No.: 898,613

[22] Filed: Aug. 21, 1986

[51] Int. Cl.[4] ..... C10L 1/32

[52] U.S. Cl. ..... 44/51; 44/62; 44/70

[58] Field of Search ..... 44/51, 62, 70; 524/765, 524/767, 599; 252/318

[56] References Cited

U.S. PATENT DOCUMENTS

| | | | |
|---|---|---|---|
| 3,234,134 | 2/1966 | Rockett et al. | 44/70 |
| 3,524,682 | 8/1970 | Booth | 252/318 |
| 3,652,497 | 3/1972 | Junas et al. | 524/599 |
| 4,130,400 | 12/1978 | Meyer | 44/70 |
| 4,138,381 | 2/1979 | Chang et al. | 524/767 |
| 4,282,006 | 8/1981 | Funk | 44/51 |
| 4,330,301 | 5/1982 | Yamamura et al. | 44/51 |
| 4,501,594 | 2/1985 | Marcellis et al. | 44/51 |

FOREIGN PATENT DOCUMENTS

| | | |
|---|---|---|
| 0109820 | 5/1984 | European Pat. Off. . |
| 2127836A | 4/1984 | United Kingdom . |

*Primary Examiner*—William R. Dixon, Jr.
*Assistant Examiner*—Margaret B. Medley
*Attorney, Agent, or Firm*—Ernest G. Szoke; Henry E. Millson, Jr.; Neal T. Levin

[57] ABSTRACT

The present invention relates to coal water slurries containing about 0.01% to 1% by weight of a water soluble terpolymer of ethylacrylate/methacrylic acid/unsaturated carboxylic acid ester of an ethoxylated or nonethoxylated alcohol or an ethoxylated carboxylic acid.

The water soluble terpolymer functions as a stablizing agent for the coal water slurry to prevent sedimentation and provide ease of pumping the coal water slurry.

The water soluble terpolymer may be used alone or in combination with anionic or nonionic dispersants.

58 Claims, No Drawings

TERPOLYMERS OF ETHYL ACRYLATE/METHACRYLIC ACID/UNSATURATED ACID ESTER OF ALCOHOLS AND ACIDS AS ANTI-SETTLING AGENTS IN COAL WATER SLURRIES

BACKGROUND OF THE INVENTION

The present invention relates to the use of terpolymers of ethylacrylate/methacrylic acid/unsaturated carboxylic acid ester of alcohols or ethoxylated carboxylic acids as anti-settling agents in coal water slurries.

One of the major problems involved in the use of coal water slurries is the transportation by pumping of the finely divided coal particles in an aqueous system particularly when the coal content is over 50% by weight. This is because the coal particles tend to settle out when the solids content is high and cause blockages in the pumping system.

However, for efficiency in transport and burning of the coal water slurry it is desirable to increase the coal content to more than 50% by weight. Moreover, by increasing the coal content, the amount of scarce water resources needed is reduced. The reduction in the volume of water in coal water slurry increases the efficiency of the coal burning process since less heat energy is required to vaporize the water present. Therefore, it is important to be able to provide a solution to the problem of pumping coal water slurries wherein the coal content is greater than 50% by weight.

Prior attempts to improve pumping of coal water slurries include the use of anionic sulfonated surfactants (see Funk U.S. Pat. No. 4,282,006 and U.S. Pat. No. 4,330,301), and anionic sulfomethylated polyhydroxy polyphenyl compounds as dispersants (see Marcellis et al, U.S. Pat. No. 4,501,594).

Funk, U.S. Pat. No. 4,282,006 describes a method wherein coal is ground to a specified range of particle sizes such that there is a minimum of void space and a maximum surface area to enhance dispersing effects generated by electrolytes and/or dispersing agents added to the slurry.

Yamamura et al, U.S. Pat. No. 4,330,301 describes sulfonated polycyclic aromatic compounds, salts thereof and formaldehyde condensates thereof as dispersants.

It is also known to use xanthan gum to prevent the coal particles from settling. However, the natural gums have a tendency to be degraded by bacteria and heat. Moreover, xanthan gum excessively increases the viscosity of the coal water slurry and causes difficulties in pumping.

Terpolymers of ethylacrylate, methacrylic acid and itaconic acid has been reported for use as thickeners for latex based paints. See published U.K. Patent Application No. 2,127,836A and EPO Patent Application No. 0109820. These have not been described as being suitable for coal water slurries as anti-settling agents. Moreover, because of the high solids content desired in coal water slurries for efficient pumping, it is undesirable to significantly increase the viscosity of coal water slurries.

Therefore, it is an objective to provide a method of preventing the coal particles from settling out of solution without significantly increasing the viscosity of the system.

It is further objective to provide anti-settling agents useful in coal water slurries that is simple to use and easy to obtain.

SUMMARY OF THE INVENTION

The present invention is directed to the use of one or more of a water soluble terpolymer of ethylacrylate, methacrylic acid and a third monomer consisting of an unsaturated carboxylic acid ester of an alcohol or an ethoxylated carboxylic acid, wherein the unsaturated carboxylic acid is a mono- or di-basic unsaturated acid containing about 3 to 10 carbon atoms selected from the group consisting of acrylic acid, methacrylic acid, itaconic acid, fumaric acid, and maleic acid; the alcohol is $-(OCH_2CH_2)_nOR$, wherein n is an integer from 0–100 and R is hydrogen, alkyl, aryl or mono or poly substituted aryl groups. The ethoxylated carboxylic acid is $$-(OCH_2CH_2)_aO\overset{\overset{\displaystyle O}{\|}}{C}R,$$

wherein a is an integer from 1–100, and R is as previously defined.

When R is alkyl, the group can be linear or branched with 8 to 30 carbon atoms. When R is aryl, it can be an aryl group with from 6 to 10 carbon atoms such as benzene or naphthalene. When R is substituted aryl, the substituent(s) can be a linear or branched alkyl group(s) with from 5 to 24 carbon atoms, an aryl group(s) with from 6 to 10 carbon atoms or an aralkyl group with from 7 to 12 carbon atoms. Examples of suitable substituent alkyl groups include but are not limited to octyl, nonyl, dodecyl or octadecyl groups. Example of suitable substituent aralkyl groups include benzyl, methyl benzyl, dimethyl benzyl, etc.

The water soluble terpolymer may also include a fourth monomer such as N-methylolacrylamide, allyl urea, diallyl amine, etc. The unsaturated acid, if dibasic, may be substituted on one or both of the carboxyl groups with alcohol or ethoxylated carboxylic acid as described above. The unsubstituted carboxyl may be in the form of an acid or a salt, wherein the cation is selected from the group consisting of organic amines, ammonium and alkali metals such as sodium and potassium.

The terpolymer is incorporated into the coal water slurry at a level of about 0.01% to 1% by weight of the slurry, preferably 0.1% to 0.5%. It can be used alone or in combination with one or more of a dispersant such as a sulfonated anionic dispersant, e.g. sulfonated naphthalene formaldehyde condensate, sulfonated sodium acetone formaldehyde condensate, etc., and a nonionic dispersant to prevent settling of coal particles from coal water slurries.

DETAILED DESCRIPTION OF THE INVENTION

The present invention is directed to stabilized coal water slurries and a method of stabilizing coal water slurries by incorporating therein about 0.01% to 1.0%, preferably 0.1% to 0.5% by weight of the slurry, of a water soluble terpolymer of ethylacrylate, methacrylic acid and an ester of an unsaturated acid of an alcohol or an ethoxylated carboxylic acid wherein the unsaturated acid is a mono- or di- basic unsaturated acid with 3 to 10 carbon atoms selected from the group consisting of acrylic acid, methacrylic acid, itaconic acid, fumaric acid, and maleic acid; the alcohol is $-(OCH_2CH_2)_nOR$, wherein n is an integer from about 0–100 and R is hydrogen, alkyl, aryl or mono or poly substituted aryl groups; the ethoxylated carboxylic acid is $$-(OCH_2CH_2)_aO\overset{\overset{\displaystyle O}{\|}}{C}R,$$

wherein a is an integer from 1–100, and R is as previously defined.

When R is alkyl, the group can be linear or branched alkyl with 8 to 30 carbon atoms. When R is aryl it can be an aryl group with from 6 to 10 carbon atoms, benzene or naphthalene. When R is substituted aryl, the substituent(s) can be a linear or branched alkyl group(s) with from 5 to 24 carbon atoms, an aryl group(s) with from 6 to 10 carbon atoms or an aralkyl group with from 7 to 12 carbon atoms. Examples of suitable substituent alkyl groups include but are not limited to octyl, nonyl, dodecyl or octadecyl groups. Examples of suitable substituent aralkyl groups include benzyl, methyl benzyl, dimethyl benzyl, etc.

The water soluble random terpolymer has the following structural formulae:

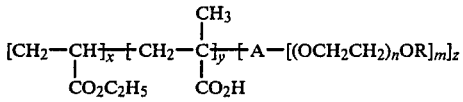

or

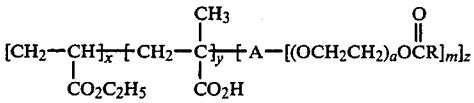

wherein A is a mono or di-basic unsaturated acid of 3 to 10 carbon atoms selected from the group consisting of acrylic acid, methacrylic acid, itaconic acid, fumaric acid, and maleic acid, m is an integer 1 or 2, and, a, n and R are as previously defined. It is most preferable that A is itaconic acid, R is nonylphenyl, m is 1, n is 30, x=50, y=40 and z=10.

A fourth monomer such as N-methylolacylamide and various amounts of chain transfer agents such as alkyl mercaptans for molecular weight control can be incorporated into the terpolymer. This polymer can be crosslinked as in (I) or not crosslinked as in (II) or (III).

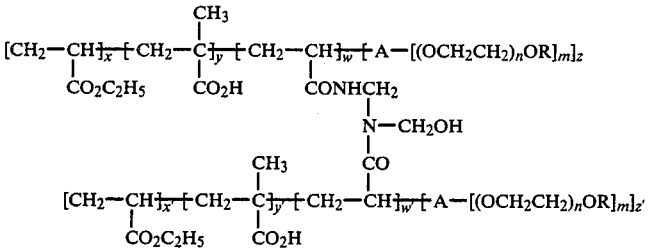

(I)

Where: X + X' = 49%
Y + Y' = 40%
Z + Z' = 10%
W + W' = 1%
100%

In the above, $-(OCH_2CH_2)_nOR$, may be replaced with $$-(OCH_2CH_2)_aO\overset{\overset{\displaystyle O}{\|}}{C}R.$$

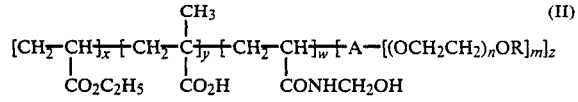

(II)

Where: X = 49%
Y = 40%
Z = 10%
W = 1%
100%

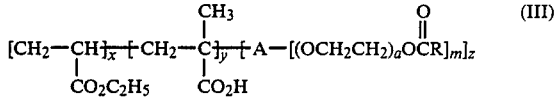

(III)

Where: X = 50%
Y = 40%
Z = 10%

The terpolymers of the present invention can be prepared as follows. The acid ester monomer is prepared by reacting a mono- or di-basic unsaturated carboxylic acid atoms with ethoxylated ROH or $RCO_2H$ in toluene solvent in a suitable ratio to make a monoester or diester as desired. The unsaturated carboxylic acid and R are as defined hereinabove. Suitable esterification catalysts and/or polymerization inhibitors are usually added to promote reaction and/or prevent polymerization. Such agents include p-toluene sulfonic acid which may be added as a catalyst, and p-methoxyphenol which may be added as a polymerization inhibitor. However, other suitable catalysts and/or polymerization inhibitor may also be used.

The mixture is heated to reflux for about 20–40 hours to remove water as an azeotrope of water and toluene. Then toluene is removed by distillation. The product, an ester of unsaturated carboxylic acid and an ethoxylated or non-ethoxylated alcohol or an ethoxylated carboxylic acid is then cooled.

To prepare the terpolymer, a surfactant suitable for emulsifying oil is mixed with water, heated to about 85° C. and sparged with $N_2$ gas in a reactor vessel.

In a second vessel, an emulsion of the three monomers and a desired additive or additives is prepared. Examples of additives which might be used include chain transfer agents or crosslinking agents such as mercaptans, alcohols, hypophosphates, N-methylolacrylamide, allyl urea, etc.

A solution of ammonium persulfate in water is added to the reactor vessel at about 80°-85° C. Then the emulsion, about 5% by weight of the total amount, is added to the reactor vessel while the temperature is maintained at about 80° C.-85° C. The reaction is allowed to initiate and stabilize. The remainder of the emulsion is added slowly together with a additional amount of ammonium persulfate in water, if necessary.

The reaction is continued at about 80° C.-85° C. until completion.

The product is a terpolymer of ethyl acrylate (EA), methacrylic acid (MAA) and an ester of the unsaturated acid.

Using the above described procedure, the following terpolymers were prepared:

(I) 50 EA/40 MAA/10 NP(EO)$_{40}$ itaconate modified with 0.15% 1-$C_{12}H_{25}SH$ and 1% N-methylolacrylamide;

(II) 50 EA/40 MAA/10 NP(EO)$_{40}$ itaconate modified with 0.4% 1-$C_{12}H_{25}SH$;

(III) 50 EA/40 MAA/10 NP(EO)$_{30}$ itaconate modified with 0.4% 1-$C_{12}H_{25}SH$;

(IV) 50 EA/40 MAA/10 NP(EO)$_{30}$ itaconate modified with 0.3% 1-$C_{12}H_{25}SH$;

(V) 50 EA/40 MAA/10 NP(EO)$_{30}$ itaconate;

(VI) 50 EA/40 MAA/10 (EO)$_{76}$ itaconate modified with 0.1% 1-$C_{12}H_{25}SH$;

(VII) 50 EA/40 MAA/10 $C_{20-22}$ carboxyl (EO)$_{76}$ itaconate modified with 0.1% 1-$C_{12}H_{25}SH$;

(VIII) 50 EA/40 MAA/10 NP(EO)$_{40}$ itaconate modified with 0.3% 1-$C_{12}H_{25}SH$;

(IX) 50 EA/40 MAA/10 $C_{16-18}$ maleate;

(X) 50 EA/40 MAA/10 $C_{12-14}$ (EO)$_9$ acrylate;

(XI) 50 EA/40 MAA/10 styrenated phenol (EO)$_9$ fumarate;

(XII) 39 EA/50 MAA/10 di-NP(EO)$_7$ itaconate diester modified with 1% allyl urea.

In the above terpolymers, EA is ethylacrylate, MAA is methacrylic acid, EO is ethylene oxide, NP is nonylphenol, 1-$C_{12}H_{25}SH$ is 1-dodecylthiol, a chain controlling agent used herein to modify the molecular weight of the terpolymer. The numerical value before each monomer represents the mole ratio of the monomer in the terpolymer; the numerical value after EO represents the average number of moles of ethylene oxide in the ethoxylated unsaturated acid ester monomer.

The water soluble terpolymers are added to coal water slurries in the range of about 0.01% to 1%, preferably 0.1 to 0.5% by weight of the slurry. It is found that the water soluble terpolymers will prevent coal particles from settling out of the slurry and result in a stabilized, pumpable slurry even after standing for several days.

The term "coal particles" encompasses solid coal which has been crushed and milled to obtain finely divided particles suitable for use in pumpable water slurries. Generally, the sizes of the particles are such that at least 80% will pass through a 200 mesh screen (U.S. Series). Useful coal include bituminous and anthracite coals, coke, petroleum, coke, lignite, charcoal, peat, admixtures thereof and the like.

Water used in the slurry may be taken from any available source such as mine, well, river, lake water or desalinated sea water having a sufficiently low mineral salt content such that the electrochemistry of the bound water layer and carrier water interface can be controlled and corrosion of milling facilities, pipelines and furnaces will be minimized and controllable.

The following examples illustrate the invention and are not to be construed as limiting the scope of the invention.

Terpolymers (I) to (XII) were used in the following experiments to evaluate their ability to prevent the settling of coal particles from the coal water slurry. The evaluation is conducted by measuring the viscosity and examining the sediment formed, if any.

COAL WATER SLURRY TEST

Apparatus Used

Weighing Balance
Glass Beaker
Metal Beaker
Weighing Dish
Spatula
Premier Mill Dispersator
Mechanical Mixer with paddle blade.

Reagents Used

Coal—Ground Pittston Coal, 80% through 200 mesh. (U.S. Series)
Tap Water
Defoamer NDW (as defoamer available from Diamond Shamrock Chemical Company, Morristown, N.J.)
$NH_4OH$
Dispersant Sulfonated ammonium oleate, sulfonated naphthalene formaldehyde condensate or Nonionic ethoxylated $C_{18}$ fatty acid (both available from Diamond Shamrock Chemical Company, Morristown, N.J.)
Terpolymer Stabilizer (I to XII)

Procedure

I. A slurry of the desired percent of coal in water is prepared as follows:
1. Weigh a desired amount of water into a metal beaker;
2. Add 0.06% by weight of the desired amount of Defoamer NDW;
3. Add 2.0% by weight of the amount of $NH_4OH$ to the water;
4. Add desired amount of dispersant;
5. Weigh a desired amount of coal into a separate beaker;
6. Weigh a desired amount of a terpolymer stabilizer into a separate weighing dish;
7. Mix the water mixture slowly with a Premier Mill Dispersator while adding the coal slowly;
8. Add then the stabilizer to the slurry;
9. Mix the slurry is at high speed and high shear at 6,000 rpm for five minutes; and
10. Then mix the slurry with a mechanical mixer using a slow paddle at 150 rpm for thirty minutes.

II. The viscosity is determined as follows:
1. Fill an 8 oz. glass jar with the coal water slurry prepared above;
2. Viscosity is measured using a Stormer Viscometer as follows: Record duplicate readings of the time in seconds and weight in grams required to turn the dial on the Stormer Viscometer one revolution. For accuracy, the time required should be in the 27-32 seconds range.
3. Convert the time and weight into Kreb units and centipoise per second viscosity by using a chart supplied with the Stormer Viscometer.

III. Settling of Coal Particles over time is determined as follows:

1. Penetration by a glass rod test: Place a glass rod into the coal slurry to test for the type of sedimentation by feel. The degree of sedimentation is indicated as HP (hard pack), SS, (soft sediment). Numbered superscripts next to SS indicates the degree of hardness by feel with 1 being the softest.
2. Sedimentation measurement readings taken by using a ruler: The initial slurry depth is measured followed by periodic measurements to note in changes depth.

% sedimentation =

$$\left(\frac{\text{initial measurement} - \text{final measurement}}{\text{initial measurement}}\right) \times 100$$

EXAMPLE 1

Preparation of Ethylacrylate/methacrylic acid/ethoxylated nonylphenoxy itaconate A monomer, mono-(ethoxylated nonylphenoxy)-itaconate was prepared by mixing 92.51 g of nonylphenol ethoxylated with 30 moles of ethylene oxide with 7.30 g of itaconic acid in toluene. The initial water content of the mixture was determined by Karl Fisher Analysis. Then 0.29 g of p-toluene sulfonic acid as a catalyst and 0.92 mg of 0.1% p-methoxyphenol in toluene as the polymerization inhibitor were added to the mixture. The water in the mixture was removed at 120° C.–130° C. as an azeotrope of toluene and water and the temperature was maintained until a minimum of 90% of the reaction was complete.

A mixture of 15 g of ethylacrylate, 12 g of methacrylic acid, and 3 g of the itaconate prepared above were added to a solution of 0.3 g of sodium lauryl sulfate in 36 g of distilled water. Vigorous stirring was used during the addition to produce an emulsion.

In a separate reactor, 30.8 mg of ammonium persulfate was mixed with 25 g of distilled water containing 0.3 g of sodium lauryl sulfate. The mixture was heated and maintained at 80°–85° C. Five percent by weight of the above prepared emulsion was added to the reactor. The temperature was maintained at 80°–85° C. while the polymerization reaction was initiated and stabilized. The remainder of the emulsion was added slowly over a period of 1–1½ hours while maintaining the temperature at 80°–85° C. Simultaneously, 1.14 mg of additional ammonium persulfate was added as a 1.25% solution in water. The reaction was continued for an additional hour after the emulsion and catalyst had been added. Next, 12 mg of additional ammonium persulfate was added as a 0.3% solution to complete the polymerization. The reaction was then maintained at 80° C. for one additional hour.

The product is an aqueous emulsion of a water soluble random terpolymer of ethylacrylate, methacrylic acid and ethoxylated nonylphenoxy itaconate with the following general structural formula:

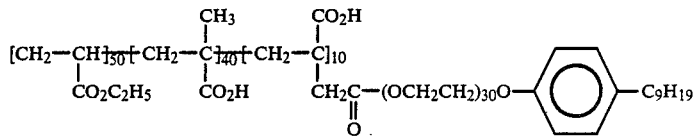

EXAMPLE 2

The procedure of Example 1 was followed with the following changes. First a 40 mole ethoxylate of nonylphenol itaconate was used instead of the 30 mole ethoxylate. Second, 0.15% 1-dodecylthiol and 17% N-methylolacrylamide were added during polymerization to control the molecular weight and crosslinking.

The product had the following general formula:

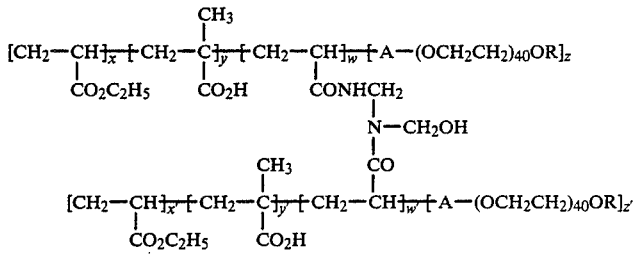

wherein A is an itaconyl moiety and R is nonylphenyl.

| Where: | |
|---|---|
| X + X' = | 49% |
| Y + Y' = | 40% |
| Z + Z' = | 10% |
| W + W' = | 1% |
| | 100% |

EXAMPLE 3

The procedure of Example 1 was followed. However, the ethoxylated nonylphenol was replaced with a $C_{20-22}$ carboxylic acid ethoxylated with 76 moles of ethylene oxide and 0.1% by weight of dodecyl thiol was added to the reaction mixture of ethylacrylate, methacrylic acid and the unsaturated carboxylic acid ester monomer.

The structural formula of the terpolymer is as follows:

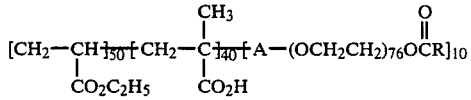

wherein A is an itaconyl moiety and R is $C_{20-22}$ carboxyl.

EXAMPLE 4

The terpolymers (I) to (XII) were evaluated as anti-settling agents for coal water slurries using the previously described procedure.

The composition of the coal water slurry used in the evaluation procedure was 64% by weight of Pittston Coal. 0.75% of an anionic dispersant, sulfonated ammonium oleate, was added to the coal water slurry. The amount of each terpolymer added was 0.15% by weight as active based on the weight of the coal water slurry.

The results are shown in Tables I–III.

TABLE I

| | Initial Viscosity | | Sedimentation | | | | | |
|---|---|---|---|---|---|---|---|---|
| | | | 1 day | | 5 days | | 7 days | |
| Terpolymer | KREBS | CPS | % | type | % | type | % | type |
| I | 121 | 3000 | 0 | NS | 13 | $SS^3$ | 25 | $SS^7$ |
| II | 87 | 1067 | 0 | SS | — | HP | — | — |
| III | 80 | 875 | 0 | SS | — | HP | — | — |
| IV | 88 | 1100 | 0 | NS | — | HP | — | — |
| V | 124 | 3188 | 0 | NS | 92 | $SS^3$ | 95 | $SS^3$ |
| VIII | 87 | 1150 | 0 | NS | — | HP | — | — |

NS = No sediment
SS = Soft sediment, superscript indicates hardness of sediment with 1 as the softest.
HP = Hard pack

TABLE II

| | Initial Viscosity | | Sedimentation | | | | | |
|---|---|---|---|---|---|---|---|---|
| | | | 1 day | | 5 days | | 7 days | |
| Terpolymer | KREBS | CPS | % | type | % | type | % | type |
| VI | 99 | 1550 | 0 | NS | 3 | $SS^3$ | — | HP |
| VII | 107 | 2350 | 0 | NS | 3 | $SS^3$ | — | HP |

TABLE III

| | Initial Viscosity | | Sedimentation | | | |
|---|---|---|---|---|---|---|
| | | | 3 day | | 7 days | |
| Terpolymer | KREBS | CPS | % | type | % | type |
| IX | 106 | 2,325 | 36 | $SS^3$ | 69 | $SS^9$ |
| X | 80 | 875 | 5 | $SS^3$ | 59 | HP |
| XI | 102 | 1,850 | 36 | $SS^3$ | 45 | $SS^9$ |
| XII | 105 | 2,300 | 9 | NS | 48 | $SS^1$ |
| V | 124 | 3,188 | 3 | NS | 19 | $SS^3$ |
| Xantham gum | 131 | 3,750 | — | NS | — | $SS^2$ |

EXAMPLE 5

Terpolymers I, V, VI and VII were re-evaluated as anti-settling agents for coal water slurries using the previously described procedure. However, a high shear rate was used to mix the stabilizer into the slurry and rather than preparing a master batch of coal water slurry, individual batches of the coal slurry were prepared. The results are shown in Table IV.

TABLE IV

| | Initial Viscosity | | Sedimentation | | | | | |
|---|---|---|---|---|---|---|---|---|
| | | | 24 hrs | | 4 days | | 7 days | |
| Terpolymer | KREBS | CPS | % | type | % | type | % | type |
| I | 90 | 1150 | 0 | NS | 0 | $SS^3$ | — | HP |
| V | 100 | 1500 | 0 | NS | 83 | $SS^8$ | 83 | $SS^9$ |
| VI | 82 | 925 | 0 | NS | — | HP | — | — |
| VII | 95 | 1300 | 0 | NS | — | $SS^8$ | — | HP |

EXAMPLE 6

Varying amounts of terpolymer V with a nonionic dispersant, a 200 mole ethylene oxide condensate of a $C_{18}$ fatty acid, were used in the following to determine the amount of anti-settling agents suitable for coal water slurries.

The amount of dispersant and terpolymer V used are in % by weight based on the total weight of the coal water slurry.

TABLE V

| | Initial Viscosity | | Sedimentation | | | | | |
|---|---|---|---|---|---|---|---|---|
| | | | 24 hrs | | 3 days | | 8 days | |
| Sample | KREBS | CPS | % | type | % | type | % | type |
| a. .50% Ethoxylated Ester (200 EO) +.15% Terpolymer V | 106 | 2325 | 0 | NS | 0 | $SS^2$ | 0 | $SS^8$ |
| b. .75% Ethoxylated Ester (200 EO) +.25% Terpolymer V | 107 | 2350 | 0 | NS | 0 | $SS^2$ | 0 | $SS^8$ |
| c. 1.0% Ethoxylated Ester (200 EO) +.35% Terpolymer V | 109 | 2400 | 0 | NS | 0 | $SS^2$ | 0 | $SS^7$ |
| d. .5% Ethoxylated Ester (200 EO) +.15% Xanthan Gum | 108 | 2375 | 0 | NS | 0 | $SS^1$ | 0 | $SS^5$ |
| e. 0.1% Sulfonated Ammonium Oleate | 74 | 700 | 0 | HP | — | — | — | — |
| f. 0.3% Sulfonated Ammonium Oleate | 67 | 480 | 0 | HP | — | — | — | — |
| g. 64% Slurry Blank | 140 | 4500 | Could not be measured | | | | | |

What is claimed is:

1. A pumpable stabilized coal water slurry, having a coal content of at least about 50% by weight wherein at least 80% of the coal particles are about 200 mesh or finer, containing from about 0.01% to about 1% by weight of said slurry of a water soluble terpolymer of ethylacrylate (A), methacrylic acid (B) and a third monomer (C) selected from the group consisting of an unsaturated carboxylic acid ester of an alcohol and an ethoxylated carboxylic acid; wherein the unsaturated carboxylic acid is a mono- or di- basic unsaturated carboxylic acid of 3 to 10 carbon atoms selected from the group consisting acrylic acid, methacrylic acid, itaconic acid, fumaric acid, and maleic acid; the alcohol is $-(OCH_2CH_2)_nOR$ wherein n is an integer of 0 to 100; the ethoxylated carboxylic acid is $$-(OCH_2CH_2)_aO\overset{O}{\overset{\|}{C}}R,$$

wherein a is an integer of about 1 to 100 and R is hydrogen, a linear or branched alkyl group with 8 to 30 carbon atoms, an unsubstituted aryl with from 6 to 10 carbon atoms, an aryl substituted with one or more of a linear or branched alkyl group with from 5 to 24 carbon atoms, an aryl with from 6 to 10 carbon atoms or an aralkyl group with from 7 to 12 carbon atoms; and wherein the mole % ratio of A:B:C is 20%–80% A:20%–80% B:1%–20% C and A+B+C is 100%.

2. A coal water slurry according to claim 1 wherein the unsaturated carboxylic acid of the water soluble terpolymer is itaconic acid.

3. A coal water slurry according to claim 1 wherein $-(OCH_2CH_2)_nOR$ is an ethoxylated nonylphenol.

4. A coal water slurry according to claim 2 wherein $-(OCH_2CH_2)_nOR$ is an ethoxylated nonylphenol.

5. A coal water slurry containing anti-settling agent according to claim 1, wherein the anti-settling agent is a terpolymer of ethylacrylate, methacrylic acid and ethoxylated nonylphenoxy itaconate ethoxylated with 30 moles of ethylene oxide and wherein the molar % ratio of ethylacrylate:methacrylic acid:ethoxylated nonylphenoxy itaconate is 50:40:10.

6. A coal water slurry according to claim 1 which further contains a sulfonated anionic dispersant.

7. A coal water slurry according to claim 6 wherein the sulfonated dispersant is sulfonated ammonium oleate.

8. A coal water slurry according to claim 6 wherein the sulfonated dispersant is sulfonated naphthalene formaldehyde condensate.

9. A coal water slurry according to claim 5 which further contains a sulfonated anionic dispersant.

10. A coal water slurry according to claim 7 wherein the sulfonated dispersant is sulfonated ammonium oleate.

11. A coal water slurring according to claim 5 which further contains a sulfonated naphthalene formaldehyde condensate.

12. A coal water slurry according to claim 1 which further contains a nonionic dispersant.

13. A coal water slurry according to claim 12, wherein the nonionic dispersant is an ethylene oxide condensate of an alkylphenol, an alkanol or a fatty acid having about 15 to 22 carbon atoms and about 40–250 moles of ethylene oxide.

14. A coal water slurry according to claim 1 wherein the anti-settling agent is a water soluble terpolymer of ethylacrylate, methacrylic acid and ethoxylated nonylphenoxy itaconate ethoxylated with 40 moles of ethylene oxide modified with 0.15% 1-$C_{12}H_{25}SH$ and 1% N-methylolacrylamide and wherein the mole % ratio of ethylacrylate:methacrylic acid:ethoxylated nonylphenoxy itaconate is 50:40:10.

15. A coal water slurry according to claim 14 further containing a sulfonated anionic dispersant.

16. A coal water slurry according to claim 15 wherein the sulfonated dispersant is sulfonated ammonium oleate.

17. A coal water slurry according to claim 15 wherein the sulfonated dispersant is sulfonated naphthalene formaldehyde condensate.

18. A coal water slurry according to claim 14 further containing a nonionic dispersant.

19. A coal water slurry according to claim 18, wherein the nonionic dispersant is an ethylene oxide condensate of an alkylphenol, an alkanol or a fatty acid having about 15 to 22 carbon atoms and about 40–250 moles of ethylene oxide.

20. A coal water slurry according to claim 1 wherein the anti-settling agent is a water soluble terpolymer of ethylacrylate, methacrylic acid, and ethoxylated $C_{20}$–$C_{22}$ carbonyloxy itaconate ethoxylated with 76 moles of ethylene oxide, modified with 1-$C_{12}H_{25}SH$ and wherein the mole % ratio of ethylacrylate:methacrylic acid:ethoxylated $C_{20}$–$C_{22}$ carboxyloxy itaconate is 50:40:10.

21. A coal water slurry according to claim 20 further containing a sulfonated anionic dispersant.

22. A coal water slurry according to claim 21 wherein the sulfonated dispersant is sulfonated ammonium oleate.

23. A coal water slurry according to claim 21 wherein the sulfonated dispersant is sulfonated naphthalene formaldehyde condensate.

24. A water soluble terpolymer of ethylacrylate (A), methacrylic acid (B) and a third monomer (C) an ester of an unsaturated carboxylic acid and an alcohol wherein the unsaturated carboxylic acid is a mono- or di-basic unsaturated carboxylic acid of 3 to 10 carbon atoms selected from the group consisting of acrylic acid, methacrylic acid, itaconic acid, fumaric acid, and maleic acid; the alcohol is $-(OCH_2CH_2)_nOH$, n being an integer from 1 to 100; and wherein the mole % ratio of A:B:C is 20%–80% A:20–80% B:1%–20% V and A+B=C is 100%.

25. A terpolymer according to claim 24 wherein the unsaturated carboxylic acid is itaconic acid.

26. A coal water slurry containing from 0.1% to about 1% by weight of said slurry of a water soluble terpolymer according to claim 24.

27. A coal water slurry containing from 0.1% to about 1% by weight of said slurry of a water soluble terpolymer according to claim 25.

28. A coal water slurry according to claim 26 further containing a sulfonated anionic dispersant.

29. A coal water slurry according to claim 28 wherein the sulfonated anionic dispersant is sulfonated ammonium oleate.

30. A coal water slurry according to claim 28 wherein the sulfonated anionic dispersant is sulfonated naphthalene formaldehyde.

31. A coal water slurry according to claim 26 further containing a nonionic dispersant.

32. A coal water slurry according to claim 31 wherein the nonionic dispersant is an ethylene oxide condensate of an alkyl phenol, an alkanol or a fatty acid having about 15 to 22 carbon atoms and about 40–250 moles of ethylene oxide.

33. A method of preventing settling of coal particles in a coal water slurry having a coal content of at least 50% by weight wherein at least 80% of the coal particles are about 200 mesh or finer, by adding about 0.01% to 1% by weight of an anti-settling agent consisting of a water soluble terpolymer of ethylacrylate (A), methacrylic acid (B) and a third monomer (C) selected from the group consisting of an unsaturated carboxylic acid ester of an alcohol or an ethoxylated carboxylic acid wherein the unsaturated carboxylic acid is a mono- or di- basic unsaturated carboxylic acid of 3 to 10 carbon atoms selected from the group consisting of acrylic acid, methacrylic acid, itaconic acid, fumaric acid, and maleic acid; the alcohol is $-(OH_2CH_2)_nOR$ wherein, n is an integer of 0 to 100; the ethoxylated carboxylic acid is $$-(OCH_2CH_2)_nO\overset{\overset{\displaystyle O}{\|}}{C}R,$$

wherein n is an integer of about 1 to 100 and R is hydrogen, a linear or branched alkyl group with 8 to 30 carbon atoms; an unsubstituted aryl with from 6 to 10 carbon atoms or aryl substituted with one or more of a linear groups with from 60 to 10 carbon atoms or an aralkyl group with from 7 to 12 carbon atoms; and wherein the mole % ratio of A:B:C is 20%–80% A:20–80% B:1%–20% C and A+B+C is 100%.

34. A method of preventing settling of coal particles in a coal water slurry according to claim 33 wherein the unsaturated carboxylic acid of the water soluble terpolymer is itaconic acid.

35. A method of preventing settling of coal particles in a coal water slurry according to claim 33 wherein $-(OCH_2CH_2)_nOR$ is an ethoxylated nonylphenol.

36. A method of preventing settling of coal particles in a coal water slurry according to claim 34 wherein $-(OCH_2CH_2)_nOR$ is an ethoxylated nonylphenol.

37. A method of preventing settling of coal particles in a coal water slurry according to claim 33, wherein the anti-settling agent is a water soluble terpolymer of ethylacrylate, methacrylic acid and epoxylated nonylphenoxy itaconate ethoxylated with 30 moles of ethylene oxide and wherein the mole % ratio of ethylacrylate:methacrylic acid:ethoxylated nonylphenoxy itaconate is 50:40:10.

38. A method of preventing settling of coal particles in a coal water slurry according to claim 33 further including a sulfonated anionic dispersant.

39. A method of preventing settling of coal particles in a coal water slurry according to claim 38 wherein the sulfonated dispersant is sulfonated ammonium oleate.

40. A method of preventing settling of coal particles in a coal water slurry according to claim 38 wherein the sulfonated dispersant is sulfonated naphthalene formaldehyde condensate.

41. A method of preventing settling of coal particles in a coal water slurry according to claim 37 further including a sulfonated anionic dispersant.

42. A method of preventing settling of coal particles in a coal water slurry according to claim 41 wherein the sulfonated dispersant is sulfonated ammonium oleate.

43. A method of preventing settling of coal particles in a coal water slurry according to claim 41 wherein the sulfonated dispersant is sulfonated naphtalene formaldehyde condensate.

44. A method of preventing settling of coal particles in a coal water slurry according to claim 33 further including a nonionic dispersant.

45. A method of preventing settling of coal particles in a coal water slurry according to claim 44 wherein the nonionic dispersant is an ethylene oxide condensate of an alkylphenol, an alkanol or a fatty acid having about 15 to 22 carbon atoms and about 40–250 of ethylene oxide.

46. A method according to claim 33 wherein the anti-settling agent is a water soluble terpolymer of ethylacrylate, methacrylic acid end ethoxylated nonylphenoxy itaconate ethoxylated with 40 moles of ethylene oxide modified with 0.15% 1-$C_{12}H_{25}SH$ and 1% N-methlolacrylamide and wherein the mole ratio of ethylacrylate:methacrylic acid:ethoxylated nonylphenoxy itaconate is 50:40:10.

47. A method according to claim 46 further including a sulfonated anionic dispersant.

48. A method according to claim 47 wherein the sulfonated dispersant is sulfonated ammonium oleate.

49. A method according to claim 47 wherein the sulfonated dispersant is sulfonated naphthalene formaldehyde condensate.

50. A method of preventing settling of coal particles in a coal water slurry according to claim 46 further including a nonionic dispersant.

51. A method of preventing settling of coal particles in a coal water slurry according to claim 50 wherein the nonionic dispersant is an ethylene oxide condensate of an alkylphenol, an alkanol or a fatty acid having about 15 to 22 carbon atoms and about 40–250 of ethylene oxide.

52. A method according to claim 33 wherein the anti-settling agent is a water soluble terpolymer of ethylacrylate, methacrylic acid, and ethoxylated $C_{20}$–$C_{22}$ carboxyloxy itaconate ethoxylated with 76 moles of ethylene oxide, modified with 1-$C_{12}H_{25}SH$ and wherein the mole % ratio of ethylacrylate:methacrylic acid:ethoxylated $C_{20}$–$C_{22}$ alkoxy itaconate is 50:40:10.

53. A method according to claim 52 further containing a sulfonated anionic dispersant.

54. A method according to claim 53 wherein the sulfonated anionic dispersant is sulfonated ammonium oleate.

55. A method according to claim 53 wherein the sulfonated anionic dispersant is sulfonated naphthalene formaldehyde condensate.

56. A method of preventing settling of coal particles in a coal water slurry according to claim 52 further including a nonionic dispersant.

57. A method of preventing settling of coal particles in a coal water slurry according to claim 56 wherein the nonionic dispersant is an ethylene oxide condensate of an alkylphenol, an alkanol or a fatty acid having about 15 to 22 carbon atoms and about 40–250 of ethylene oxide.

58. A monomer consisting of an unsaturated carboxylic acid ester of an alcohol wherein the unsaturated carboxylic acid is a mono- or di-basic unsaturated acid of 3 to 10 carbon atoms selected from the group consisting of acrylic acid, methacrylic acid, itaconic acid, fumaric acid and maleic acid and the alcohol is $-(OCH_2CH_2)_nOH$, n being an integer from 1 to 100.

* * * * *